US006198032B1

(12) United States Patent
Thompson

(10) Patent No.: US 6,198,032 B1
(45) Date of Patent: Mar. 6, 2001

(54) ANGLED MOUTHPIECE FOR WIND INSTRUMENT

(76) Inventor: Robert Shawn Thompson, 15369 68th Ave. N., Maple Grove, MN (US) 55311-3252

( * ) Notice: Subject to any disclaimer, the term of this patent is extended or adjusted under 35 U.S.C. 154(b) by 0 days.

(21) Appl. No.: 09/518,243

(22) Filed: Mar. 3, 2000

(51) Int. Cl.[7] ..... G10D 9/02
(52) U.S. Cl. ..... 84/398; 821/399
(58) Field of Search ..... 84/398, 399, 383 R

(56) References Cited

U.S. PATENT DOCUMENTS 2,175,191 * 10/1939 Goyette ..... 84/399
2,258,312 * 10/1941 Adkins ..... 84/399

* cited by examiner

*Primary Examiner*—Robert E. Nappi
*Assistant Examiner*—Shih-yung Hsieh

(57) ABSTRACT

This invention consists of a wind instrument mouthpiece primarily intended for trumpet or cornet, although it could be utilized for other wind instruments as well without departing from the concept of the invention. It features an angled shank as the preferred embodiment of the invention. The mouthpiece could also be constructed with a curved shank or with an angle at the juncture of the shank and the cup of the mouthpiece as alternative embodiments. The upswept angle of the mouthpiece allows the player to maintain a horizontal bell position while tilting their head downward. This mouthpiece configuration elevates the bell of the horn while in use which benefits the student musician both acoustically and aesthetically. The professional musician would benefit from using this mouthpiece during high register play during which time the demand on the players embouchure is shifted more to the upper lip resulting in a descending bell playing position. This mouthpiece will benefit the student and professional musician by enhancing their tonal quality while improving their playing posture.

3 Claims, 1 Drawing Sheet

ANGLED MOUTHPIECE FOR WIND INSTRUMENT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to a wind instrument mouthpiece primarily intended for a trumpet or cornet, but it could be utilized for other wind instruments without departing from the concept of the invention. It is known for a wind instrument mouthpiece to have a straight shank leading to the cup of the mouthpiece, as is illustrated in U.S. Pat. No. 828,979 and U.S. Pat. No. 1,691,669 and U.S. Pat. No. 2,104,388 and U.S. Pat. No. 3,370,500 and U.S. Pat. No. 4,395,933 and U.S. Pat. No. 5,969,280. This mouthpiece differs from all prior art because it has an angled shank. The shank of this mouthpiece angles upward to the cup of the mouthpiece. The first model of this mouthpiece was made from a popular brand of mouthpiece by heating and bending the shank of the mouthpiece. Several other angled and curved models were constructed from other brands of mouthpieces using this method. The upward angle of the mouthpiece serves a dual purpose. The upward angle of this mouthpiece causes the bell of the horn to be elevated while playing. A student would utilize this angled mouthpiece to remedy a descending bell position, or bad playing posture. The student would benefit by utilizing this mouthpiece to help keep the bell of the horn in a horizontal position while playing. Keeping the bell of the horn in a horizontal position while playing enhances the sound quality of the instrument because it allows the sound wave to be directed at the audience and not at the student or music stand directly in front of the horn player. In addition to the acoustical enhancement, the corrected playing position of the student would give the band or orchestra in which the student plays a more uniform appearance. A professional musician would utilize this mouthpiece to keep the bell of the horn level while playing high register notes during which time the embouchure demands shift to the players upper lip which causes the bell of the horn to be lowered. This mouthpiece provides an affordable improvement for those players who desire better playing posture and tonal quality.

BRIEF SUMMARY OF THE INVENTION

This invention relates to an improvement in a wind instrument mouthpiece primarily for trumpet or cornet, this invention could also be utilized on various other wind instruments without departing from the concept of the invention. The standard design of a wind instrument mouthpiece utilizes a straight shank such as in U.S. Pat. No. 828,979 and U.S. Pat. No. 5,969,280, and all other mouthpiece art up to this point. This invention embodies a wind instrument mouthpiece which has an angled or curved shank or an angle at the juncture of the mouthpiece shank and the mouthpiece cup. When in use the shank of this mouthpiece extends straight outward from the lead tube of the wind instrument and then angles or curves upward to the cup of the mouthpiece. The shank of the mouthpiece could alternatively be straight with an upward angle at the juncture of the shank and the cup of the mouthpiece without departing from the concept of this invention. Several models of each configuration have been produced by heating and bending various brands of mouthpieces and none have exhibited any change in pitch or timber. The upward angle of this mouthpiece causes the bell of the wind instrument to be elevated while being played. This new mouthpiece configuration will benefit both the student and the professional musician. Many student trumpet and cornet players have the bell of their instruments pointed downward while they play. When a trumpet or cornet player has the bell pointed downward while playing, much of the sound wave is being reflected off their music stand or absorbed by players directly in front of them. A descending bell position may also result in saliva collecting in the tuning slide of the trumpet or cornet causing a sputtering sound to emanate from the instrument. This invention can enhance the acoustical quality and playing posture of many student horn players. A professional musician would employ this mouthpiece while playing high notes during which time the demand on the players embouchure is shifted more to the upper lip. While playing in the upper register the tendency for many musicians is to tilt their head downward so that they can employ more of their upper lip which results in a descending bell playing position. The upward angle of this mouthpiece permits the player of the trumpet or cornet to tilt their head downward while playing and still maintain a horizontal bell position which directs the sound wave at the audience and not at the floor in front of them. This invention will benefit both the student and professional musician by enhancing their tonal quality and also improve their playing posture.

DETAILED DESCRIPTION OF THE INVENTION

Figure 1:
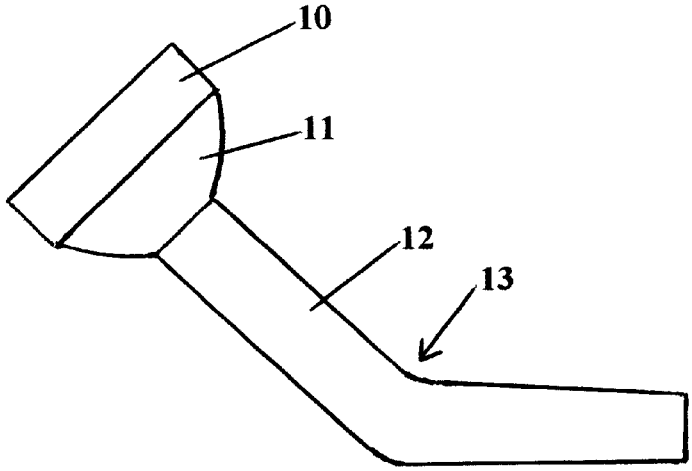
FIG. 1 is a side elevational view of the mouthpiece with an angled shank which is the preferred embodiment of this invention.

FIG. 1 depicts the mouthpiece with an angled shank which is the preferred embodiment of this invention. Point 10 is the rim of the mouthpiece. Point 11 is the cup of the mouthpiece. Point 12 is the angled shank of the mouthpiece. Point 13 is the point at which the shank of the mouthpiece angles upward toward the cup of the mouthpiece. The degree of the angle and the point of the onset of the upward angling of the shank of the mouthpiece could be altered without departing from the concept of the invention. The rim, cup, throat, backbore and shank dimensions are not given here because various combinations of these dimensions could be utilized without departing from the concept of this invention.

Figure 2:
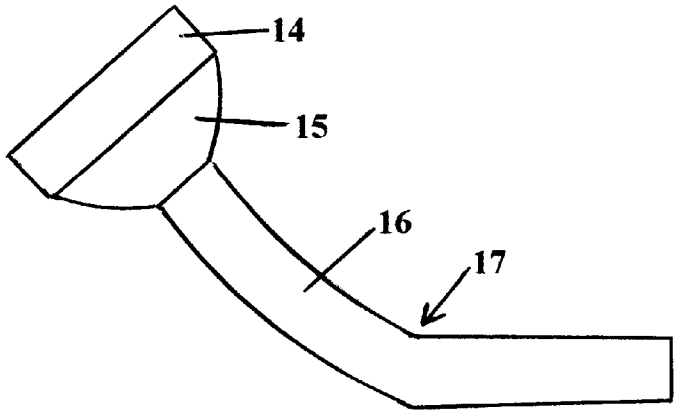
FIG. 2 is a side elevational view of the mouthpiece with a curved shank which is an alternative embodiment of this invention.

FIG. 2 depicts the mouthpiece with a curved shank which is an alternative embodiment of this invention. Point 14 is the rim of the mouthpiece. Point 15 is the cup of the mouthpiece. Point 16 is the curved shank of the mouthpiece. Point 17 is the point at which the shank of the mouthpiece begins its upward curvature toward the cup of the mouthpiece. The gradient of the curvature and the point of the onset of the upward curvature of the shank of the mouthpiece could be altered without departing from the concept of this invention. The rim, cup, throat, backbore and shank dimensions are not given here because various combinations of these dimensions could be utilized without departing from the concept of this invention.

Figure 3:
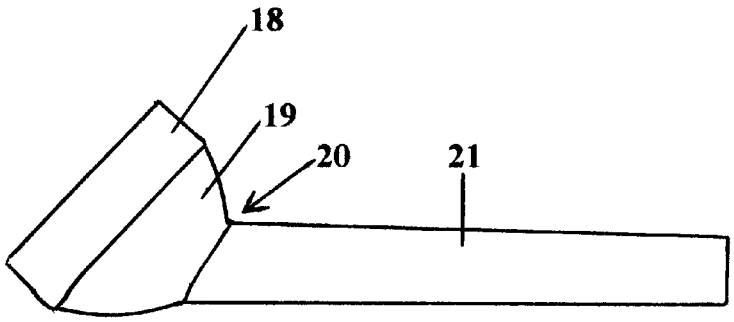
FIG. 3 is a side elevational view of the mouthpiece with a straight shank which angles upward at the juncture of the shank and the cup of the mouthpiece which is an alternative embodiment of this invention.

FIG. 3 depicts the mouthpiece with a straight shank which angles upward at the juncture of the shank and the cup of the mouthpiece which is an alternative embodiment of this mouthpiece. Point 18 is the rim of the mouthpiece. Point 19 is the cup of the mouthpiece. Point 20 is the juncture of the shank and the cup of the mouthpiece at which point the cup of the mouthpiece angles upward from the shank of the mouthpiece. Point 21 is the straight shank of this mouthpiece. The degree of the angle at the juncture of the shank and the cup of this mouthpiece could be altered without departing from the concept of this invention. The rim, cup throat, backbore and shank dimensions are not given here because various combinations of these dimensions could be utilized without departing from the concept of this invention.

I claim:

1. A wind instrument mouthpiece comprising: a rim, a cup, and a shank, said shank being angled upward toward said cup of the mouthpiece.

2. The mouthpiece of claim 1, wherein said shank having two straight portions from a location said shank being angled, one straight portion being connected to said cup.

3. The mouthpiece of claim 1, wherein said shank having one straight portion and one curved portion from a location said shank being angled, said curved portion being connected to said cup.

* * * * *